US005595482A

United States Patent [19]

Parsons

[11] Patent Number: 5,595,482

[45] Date of Patent: Jan. 21, 1997

[54] AIRLOCKING SYSTEM AND METHOD FOR FEEDING BULK GRANULAR MATERIAL

[76] Inventor: Marshall F. Parsons, 4 Meadow Grass Ct., Gaithersburg, Md. 20878

[21] Appl. No.: 329,823

[22] Filed: Oct. 27, 1994

[51] Int. Cl.[6] ..... F27D 1/08

[52] U.S. Cl. ..... 432/95; 432/96; 432/97; 432/239; 432/242; 110/165 R; 110/171

[58] Field of Search ..... 432/1, 95, 96, 432/97, 239, 242; 110/165, 171

[56] References Cited

U.S. PATENT DOCUMENTS

| | | |
|---|---|---|
| 2,610,749 | 9/1952 | Somogyi . |
| 3,319,808 | 5/1967 | Sacket, Sr. . |
| 3,933,103 | 1/1976 | Mikkelsen . |
| 4,708,643 | 11/1987 | Nagl et al. . |

FOREIGN PATENT DOCUMENTS

| | | |
|---|---|---|
| 2151338 | 7/1985 | United Kingdom . |

OTHER PUBLICATIONS

"Typical present day art" collection supplied by applicant--about Apr. 4, 1994.

*Primary Examiner*—Henry A. Bennett
*Assistant Examiner*—Siddharth Ohri
*Attorney, Agent, or Firm*—Marvin S. Towsend

[57] ABSTRACT

A control measuring and supply apparatus and method for receiving a substantially, continuous flow of fluent material from a source of supply; the assembly having a bottom-sealed diverter plate, optionally positionable to direct the fluent material, by gravity, to either one or the other of a pair of adjacent, parallel supply chambers, each of the supply chambers having lower, sealed valve plates which can be optionally opened or closed, a and visa versa, one of the supply chambers being filled with the fluent material while the other is simultaneously emptied, and power operated control motors for controlling the operation of the diverter and valve plates; the diverter plate and valve plates cooperating with seals disposed out of the path-of-movement of the fluent material.

11 Claims, 2 Drawing Sheets

AIRLOCKING SYSTEM AND METHOD FOR FEEDING BULK GRANULAR MATERIAL

FIELD OF THE INVENTION

This invention relates to the feeding of bulk materials such as stone, ore, gravel, etc. into furnaces, kilns, dryers or similar process devices where such devices are operated at negative or positive pressures relative to atmosphere, and it is desired to prevent the leakage of air or furnaces gases into or out of the device.

It relates particularly to material which is normally too coarse to be handled by pneumatic or fluidized conveying systems or material which contains lumps which would affect such systems.

DESCRIPTION OF THE PRIOR ART

The requirement of introducing such materials without leakage has been accomplished by the use of superimposed storage bins or surge hoppers which are filled and then sealed on a periodic basis. Such arrangements require increased support structures and as the filling of the storage must be accomplished in a short a period as possible, conveying systems must be of very high capacity. A true continuous airlocking system, where the material is added at approximately the same as the processing rate, is therefore advantageous.

One system presently in use is the rotary vane type of feeder. To be effective as a sealing mechanism, the vane must fit the cylinder with close tolerance. Lumps of coarse material can be caught between a vane and the edge of the feed opening in the cylinders causing jamming and stoppage and even breaking of the device.

Some systems attempt to alleviate this problem with a spring relief plate at the feed point which moves to allow passage of the lump. This of course reduces the sealing effect and allows leakage. All these devices are subject to wear of the close tolerance surfaces by the abrasion of the feed material, so that they require frequent rebuild to maintain their sealing ability and the resultant shut-down and start-up of the furnace, kiln, dryer, etc. being supplied with the fluent, coarse bulk material.

Other systems presently in use consist of two or more chambers arranged in series with sealing gates that operate sequentially so that one or the other gate is closed at any given time as shown, for example, in the patent to Mikkelsen U.S. Pat. No. 3,933,103. A problem with this arrangement is that the upper gate must close on the continuous stream of materials. In the case of coarse or lumpy material, a lump may be caught in the gate, holding the gate open so that when the second gate opens, the sealing action is lost. Such action may also damage the mechanism.

Another difficulty with such systems is that the capacity of the system is determined by the volume of the chamber between the sealing gates and the cycling frequency of the chamber. This requires a high cycling rate with subsequent undesirable, increased maintenance problems.

SUMMARY OF THE INVENTION

The object of this invention is to avoid the problems mentioned and to provide a simple rugged system to continuously feed large volumes of coarse, lumpy material, by gravity flow, into or out of a sealed vessel which is at a pressure differential from the atmosphere or the external point of feed, without significant gas leakage.

This is accomplished by the use of two chambers arranged in parallel, having a common dividing partition. Each chamber has a bottom discharge gate which opens to discharge material and is sealed when in the closed position.

At the top of these two chambers is a feed chamber containing a diverter plate which is pivoted on a shaft located immediately above and parallel to the common dividing partition of the two lower chambers. The diverter plate has a dual function of directing the continuous stream of material to one of the lower compartments while simultaneously sealing the top of the other lower compartment.

The plate may be shifted from one side to the other by actuating the pivot shaft by any suitable mechanism or power-application device. In this manner the chambers may be sequentially sealed on the top while the bottom discharge gate discharges its material and closes on an empty chamber, as shown in the schematic operating diagram.

The proposed system has the following advantageous features:

1. The closing or sealing surfaces never close on a continuous stream of material. The lower discharge gates close on empty chambers. The diverter plate passes through the stream of material when moving from one position to the other, but the sealing surfaces are remote from the stream and are thus not subject to abrasive wear.
2. The diverter plate and sealing surfaces are comprised of only one moving part. The diverter plate has cover plates on each end having a modified sectoral shape, which confines the material to the center of the plate. Sealing surfaces are placed peripherally. On the ends, extension plates are mounted outside the sectoral end plates, but in the plane of the diverter plate. These plates close on the surfaces of a recess in the end walls of the upper compartment. The recess is covered by the diverter end plates to prevent material access and material movement therethrough.

The upper end of the diverter plate, as it moves from one side to the other, passes through and out of the stream of material and then passes under a flexible wiping surface which will release impacted lumps if a lump did get caught between the surfaces. After passing this release portion , the plate seals on a fixed surface. All sealing surfaces in the top section are fitted with compressible gaskets of suitable materials. With this type of construction, close-tolerance, machined surfaces are not required.

A further advantage of this arrangement is that the two compartments in parallel effectively double the volumetric capacity of the system compared to a series arrangement. This relationship, combined with larger compartments, gives a much lower cycling frequency.

A prototype design has a cycling rate of 3 cycles per minute on each discharge gate, compared with 18 cycles per minute on devices presently in use with comparable capacities. Slower operating speed may be used and, these slower speeds allow the use of simplified construction and greatly reduce maintenance. The lower speed of the activator mechanisms also reduces power-operating requirements. Individual actuators are used for the two discharge gates and the diverter plate. Any suitable electric or electric-hydraulic-pneumatic power system can be programmed with solid state control to accomplish the desired sequencing schedule and rate.

Another object of the invention is to provide a bulk material, charging system in which the in-flowing bulk material essentially cleans a diverter or valve plate which sequentially directs bulk material into at least two adjacent holding chambers, one of which is being filled while the other is being emptied into the apparatus being service.

Still another object of the invention is to provide a novel diverter plate incorporating sealing means not subject to interference or wear by the flowing bulk materials being controlled by the diverter plate.

Yet another object of the invention is to provide a novel two-stage valve or diverter plate assembly, which can be removed as a unit for servicing and replaced by a serviced unit, minimizing start-up and shut-down times of the kiln, furnace or dryer being serviced.

A still further object of the invention comprises a method for continuously supplying fluent material to a kiln, furnace or the like by diverting the supply of material to one or the other of a pair of parallel supply chambers while maintaining one of the supply chambers sealed at the top while being emptied, and the other being sealed at the bottom while being filled with the fluent material, whereby supply time is minimized, and heat and pressure loses from the kiln or furnace are minimized.

These together with other objects and advantages will become apparent from a consideration on the following description in conjunction with the drawing forming a part thereof, in which:

DESCRIPTION OF THE PREFERRED EMBODIMENT

Figure 1:
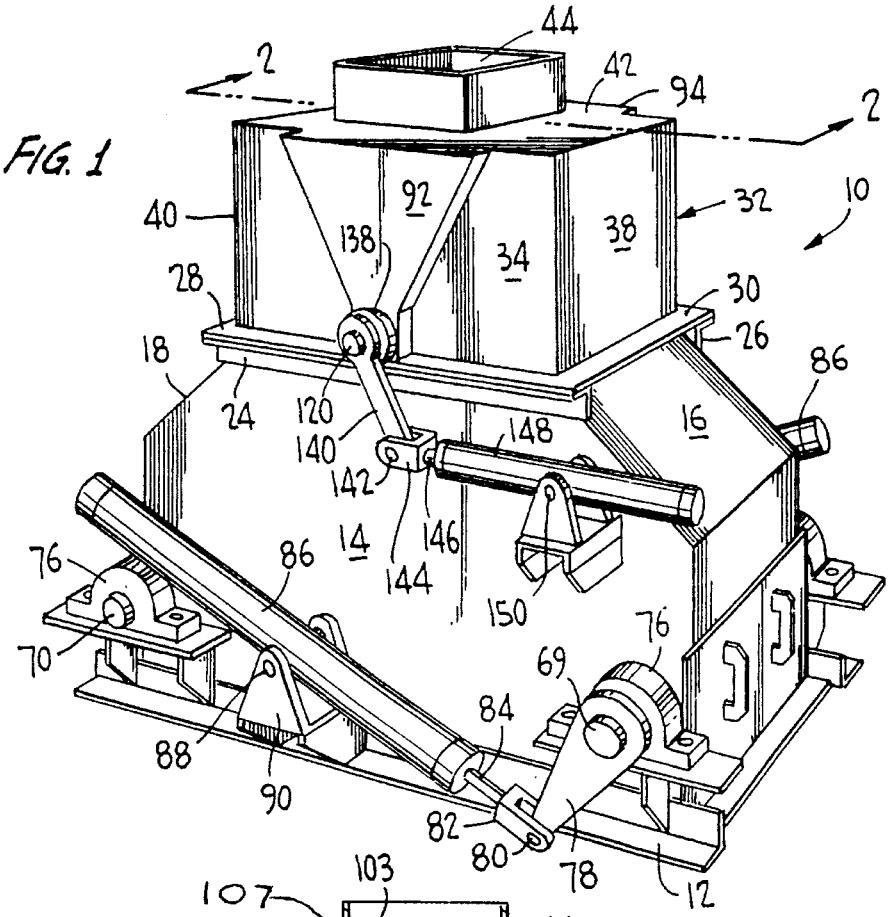
FIG. 1 is a perspective view of the bulk material control assembly.
Figure 2:
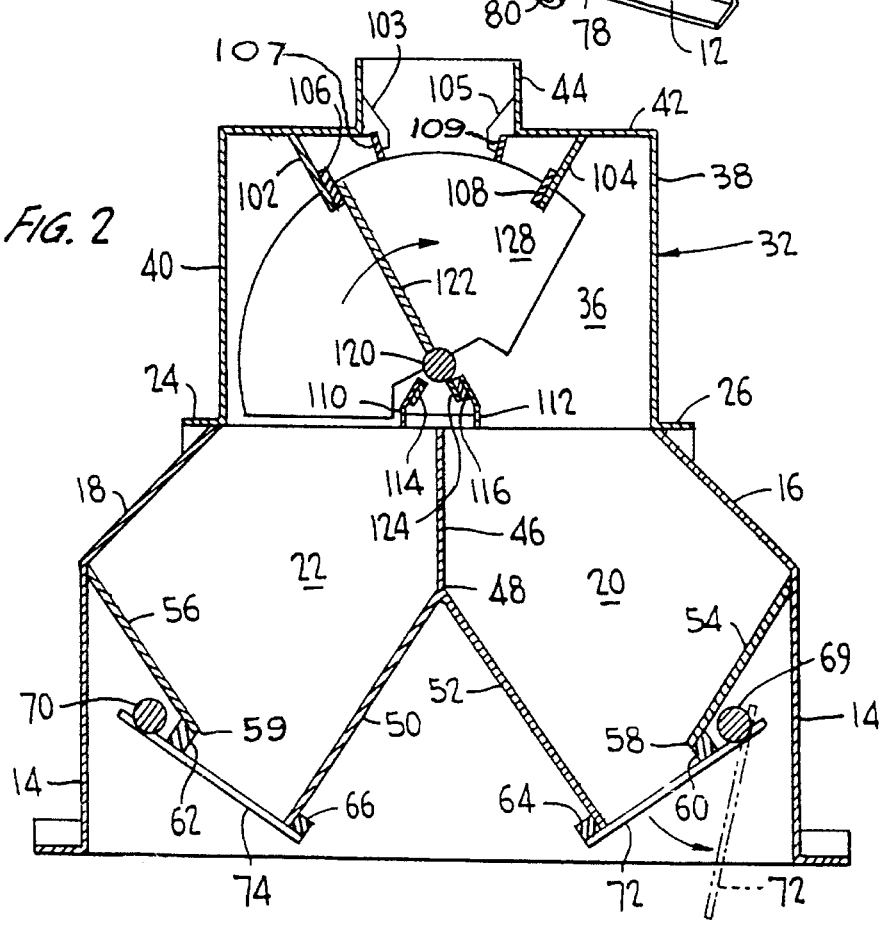
FIG. 2, is a vertical section taken approximately on the plane of line 2—2 of FIG. 1.

Referring to FIG. 1, a combined diverter plate valve assembly is indicated generally at 10 being constructed of suitable tempered steel plates welded together. The assembly 10 comprises a bottom-mounting flange structure 12 integral with a lower, generally rectangular, housing 14 having opposite, divergent top portions 16 and 18 which form upper walls of holding chambers 20 and 22; as best seen in FIG. 2.

The housing 14 has integral with the upper edges, at opposite sides thereof angle irons 24 and 26, to which are attached opposed, integral flanges 28 and 30, respectively, of an upper rectangular chamber 32. The chamber 32 has side opposite side walls 34 and 36 integral with end walls 38 and 40, a top plate 42 which has a rectangular inlet collar 44 with sides respectively parallel to sides 34–40 of the upper rectangular chamber 32.

Within the lower rectangular chamber 14 is a transverse, central partition 46, integrally connected at its lower edge 48 to upper edges of divergent plates 50 and 52. Plates 50, 52, 54 and 56 are at an appropriate angle to facilitate discharge of the particulate material from the compartments holding chambers 20 or 22. As seen in FIG. 2, the common wall 46, together with the walls 18, 50 and wall 40, generally define the confines of holding chamber 22, while the common wall 46, walls 16, 52 and upper wall 38, define the confines of holding chamber 20.

The bottom of the respective holding chambers 20 and 22, comprise transverse plates 54 and 56 angling inwardly from walls 16 and 18, respectively, and including at their respective lower edges 58 and 59 and elongate seal 60 and 62, respectively. The divergent plates 50 and 52 also include respective integral seals strips 60, 64 and 62, 66. Pivotally mounted on a transverse shaft 69 and 70, respectively, are lower trap-plate or valve plates 72 and 74, respectively, which cooperate with seals 60, 62, and 62, 66 and 64, 68 to effectively seal pressures therebelow, when closed as seen in FIG. 2.

Bulk material contained in either holding chamber 20 or 22, descends by gravity therebelow, when either of the plates 72 or 74 are swung downwardly away from their respective seals. Thus the bottom of the holding chambers, i.e. valve plates at chambers 20 and 22 (see 72 in phantom lines in FIG. 2), can be sequentially swung away or toward their seals depending if the holding chambers are being filled or emptied. The furnace, kiln or dryer, etc, is not shown in detail, however, the housing 14 will rest upon the apparatus being served with bulk material and while a load of bulk, fluent material is being charged from one chamber into the apparatus being serviced, the other holding chamber will be effectively sealed and is being loaded, without material change of pressure in the apparatus being serviced.

The shafts 69 and 70 project, at opposite ends, through opposite walls at the rectangular housing 14, being journalled in suitable bearing block assemblies shown 76. THe shafts each include a lever arm 78, pivotally connected at 80 by a clevis 82 of a piston rod 84. The piston rod 84, is reciprocal relative to a piston housing 86 intermediately pivoted at 88 on a suitable fulcrum bracket 90. The piston 86 and rod 84 comprise a power motor which can be fluid-pressure operated or operated electromagnetically; in any event, a suitable power unit can be used to sequentially "open" and "close" the lower-trap plates 72 and 74.

Figure 4:
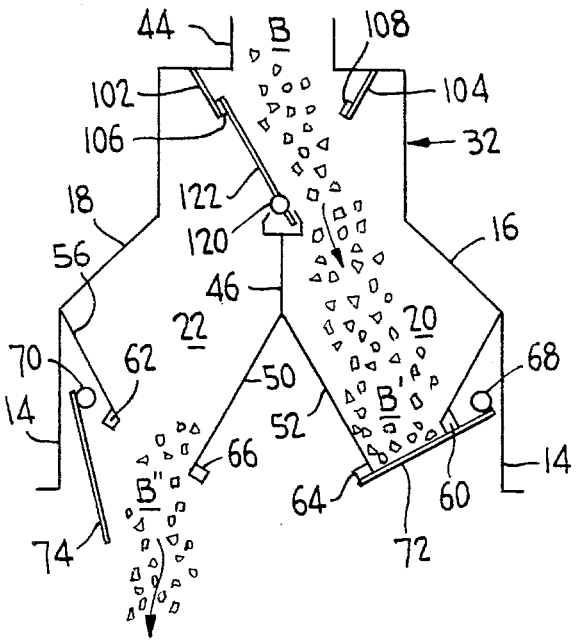
FIG. 4 is a schematic view showing operation of one valve plate in one holding chamber, which was previously filled, is being emptied, and in which the adjacent chamber is sealed and being filled with bulk material.
Figure 5:
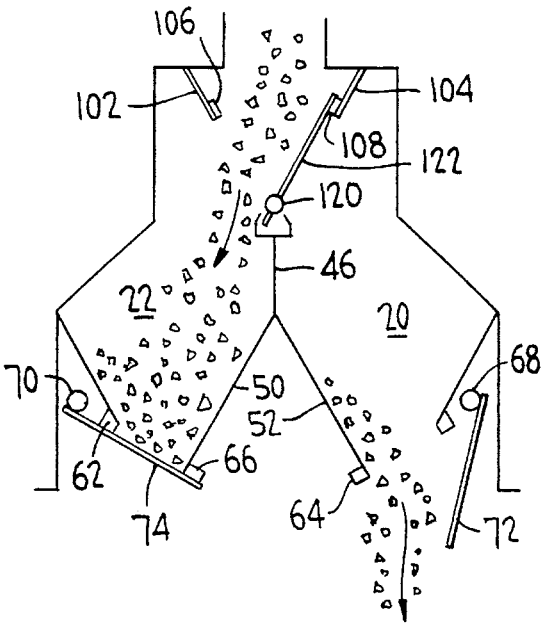
FIG. 5, is a view similar to FIG. 4, showing the chamber being filled in FIG. 4, being emptied, while the adjacent chamber is now sealed and being filled through redirection of material by the diverter plate.

Referring to FIGS. 4 and 5, alternate opening and closing of the trap-plates or valve plates 72 and 74 permits gravity unloading of the holding chambers. The bulk material, as it descends, wipes or flows across the upper face of the respective trap plates and the discharge assists in keeping these plates clean. Further, the seals 60, 64 and 62, 66 are positioned out of the path-of-travel of the discharging bulk material, thus minimizing replacement and wear of these seals.

Figure 3:
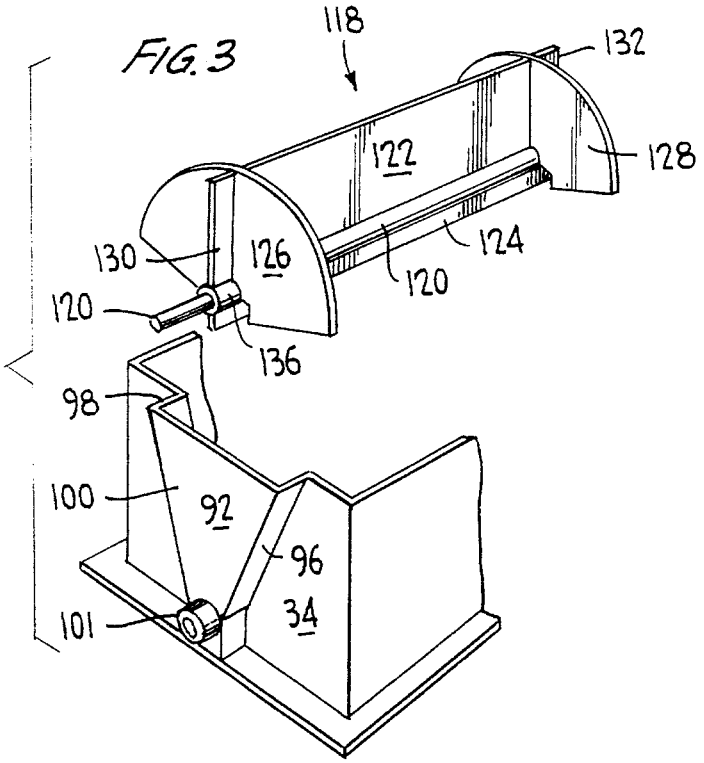
FIG. 3 is an exploded perspective view, on an enlarged scale, showing details of the diverter plate and the sealing areas with which it cooperates.

The opposite walls 34, 36 of the upper rectangular chamber 32 each have formed therein recessed, sealing areas 92 and 94 each opening inwardly toward each other as seen in FIG. 3. The recessed sealing areas 92, 94 (only one being described in detail), each have downwardly converging seal portions 96, 98 integral with an outer end plate 100. At the lower end of the sealing areas (strips) is a bearing 101 for an upper diverter plate to be described.

As seen in FIG. 2, within the housing 32, extending transversely between walls 34, 36 are inwardly converging support strips 102 and 104, having on the upper surfaces thereof longitudinal sealing strips 106 and 108, respectively. These sealing strips will engage the opposite surfaces of the diverter plate, which plate will shield them from engagement by abrasive action of the bulk material descending to one or the other of the holding chambers 20, 22. Here too, is an expedient for protecting these seals so replacement is minimized. At the apex or lower end of the recessed sealing areas, extending transversely between walls 34, 36 are support strips 110 and 112, which have on their respective inner, confronting surfaces sealing strips 114 and 116, respectively.

Referring to FIG. 3, a diverter plate assembly is indicated generally at 118, comprising a support shaft 120 to which is secured a diametrically projecting upper plate 122 and a lower depending sealing strip 124. Fixed in spaced relation, inwardly of the ends of the shaft 120, are arcuate sector plates 126 and 128 which have fixed on their outer surface, radial seal strips 130 and 132, respectively. The strips are mounted on the shaft 120 in any suitable manner.

The sector plates 126 and 128 effectively close the inner ends respective, of the recessed sealing areas 92, 94. The shaft 120 extends transversely between ends of the recesses 92, 94 and project therebeyond, being journalled in bearings 101 (only one shown). When the diverter plate is installed in the housing 32, the plate 122 will be effective to engage, at its upper edge, either seal 106 or 108. The lower sealing strip 124 will engage either seal 114 or 116, depending if material is being directed into holding chamber 20 or 22. As shown in FIG. 2, when the upper edge of plate 122 engages seal 106, the strip 124 will engage seal 116 as bulk materials flow into chamber 20 (when the parts are in the attitude shown in FIG. 2) the material does not engage the seals 106, 116 which are protected beneath plate 122 and strip, 124. As mentioned before, the sector plates close off the end recesses 92 and 94, and the seal strips 130 and 132 will engage one or the other of the converging seal portions 96 or 98.

As seen in FIG. 1, the shaft 120 has fixed thereto, a radial lever 140 pivotally connected at 142 to a clevis 144 of a piston rod 146, of a piston housing 148 intermediately pivoted at 150 on a support bracket fixed to the outer surface of housing 14.

Also supported between the walls 34, 36 (as seen in FIG. 2,) are deflector bars 103, 105 on which are suitably mounted resilient wiper strips 107, 109, respectively which are disposed in the path of travel of the diverter plate 122 whereby when the diverter plate is pivoted onto the seals 104 or 106, the upper edge thereof will engage the resilient wiper strips 107, 109 and thus the upper edge of the diverter plate will be maintained free of the fluent material being controlled.

OPERATION

Bulk material B will be continuously fed from a suitable conveyor; not shown, to the inlet at collar 44. The diverter plate 122, as seen in FIG. 4, will engage seal 106 on the upper surface of the support strip 102. This effectively seals off chamber 22 which has been previously filled with bulk material; at this time valve plate 74 is pivoted downwardly off seals 62, 66 permitting the bulk material B' contained in chamber 22 to gravity descend into the kiln, furnace or the like therebelow. It will be observed that seal 106 is out of the path of travel of the bulk material B, and passage over the exposed surface of the diverter plate 122, effects a cleaning action while the material descends into chamber 20. Further, the bulk material is effective to force the diverter plate 122 onto seal 106 thus providing a pressure seal.

If the pressure in the kiln is greater than in the supply chamber, this forced or pressure seal, is effective to prevent pressure and heat losses from the kiln or furnace.

At the same time chamber 22 is being emptied of bulk material B', the valve plate 72 is in engagement at its upper surface with seals 60, 64. As bulk material passes over the upper surface of valve plate 74, it tends to wipe or clean the upper surface of this plate. During the period chamber 22 is being gravity-emptied, chamber 20 is being filled with bulk material B". The lower flange of the diverter plate 124 will be in sealing engagement with seal 116; here too, the bulk material passing over the upper surface of diverter plate 122 will not come into wearing engagement with the seal 116.

After chamber 22 is emptied, when chamber 20 is filled with he bulk material B", the procedure, or positioning of the diverter plate, is reversed as seen in FIG. 5, i.e. diverter plate 122 is pivoted onto seal 108 with the lower flange 124 engaging seal 114 on support 110. Valve plate 74 is pivoted into engagement with seals 62, 66 closing off the bottom of supply chamber 22. Valve plate 72 is pivoted on shaft 69 away from seals 60, 64; and the bulk material B" gravity descends into the kiln, furnace, etc. The bulk material B" does not engage the seals 60, 64 and these seals are thus protected from wear and maintenance of seals is minimized.

Briefly, summarizing, while one chamber (20, 22) is being emptied or filled, the other is opened at the bottom, thus affording a continuously-available supply of bulk material to kiln or furnace being serviced, without loss of furnace or kiln pressure or heat losses. Of course, the speed of operation depends to a degree on the flowability of the bulk material, depending upon grain size, wherein sands of relatively small grain size, will not have the same flow characteristics of relatively larger gravel, for example.

Briefly, describing the unique method afforded by the single diverter plate controlling parallel or adjacent supply chambers, the following steps are afforded:

Continuously supplying a fluent material to an inlet common to a pair of parallel adjacent supply chambers; closing off the inlet to one of the supply chambers while opening the inlet of the other chamber by positioning a common diverter plate into the respective open and/or closing attitudes, opening the bottom of one of the supply chambers for gravity emptying the same, while simultaneously closing the bottom of the other supply chamber, whereby one chamber is being filled while the other is being emptied, and reversing the position of the diverter plate and reversing the procedure whereby the other supply chamber is filled, while that initially being filled is emptied.

The device system and method functions under both negative and positive pressure differential conditions, i.e., where the pressure in the apparatus being charged is less than or greater than atmospheric conditions. For example, referring to FIGS. 4 and 5, where the pressure is greater than atmospheric pressure, i.e. greater than the pressure at B, valve plate will be subject to the greater pressure (at its lower surface) urging it to close chamber B'. At the same time, material flowing from B into B', will engage the upper surface of plate 122 urging it onto seal 106; see FIG. 4.

When chamber B' is closed as seen in FIG. 5, the material reacts on top of plate 122 closing off 20, while pressure below plate 74 urges it closed.

Where the pressure differential in the apparatus being serviced is less than that at B, plate 122 is urged by the greater pressure onto its seal 106 or 108, while the reduced pressure below chamber B' or B" assists in opening the chambers during discharge.

Obviously, any modifications and/or variations of the present invention are possible within the above disclosure and teachings. It is therefore, to be understood that within the scope of the appended claims, the invention may be practiced otherwise than is specifically described.

What is claimed is:

1. Apparatus for feeding a supply of fluent material to a process device, comprising:

housing means which includes an upper inlet for admitting fluent material to said housing means and a pair of lower outlets for selectively emptying fluent material from said housing means;

control chamber means, contained within said housing means, wherein said upper inlet of said housing means serves as an inlet to said control chamber means, a pair of adjacent parallel supply chamber means in communication with said control chamber means, wherein each of said pair of supply chamber means includes a supply chamber inlet and a supply chamber outlet, and wherein each of said pair of supply chamber means selectively receives fluent material from said control chamber means through a respective supply chamber inlet, pivotally-mounted, single diverter plate means contained within said control chamber means for directing continuously flowing fluent material to either one or the other of said pair of adjacent parallel supply chamber means and for sealing either one or the other of said adjacent parallel supply chamber means, a pair of control valve plate means for respectively controlling gravity discharge of fluent material from said pair of parallel supply chamber means through said pair of lower outlets of said housing means and for sealing said lower outlets of said housing means, power-operated, diverter plate motor means, supported by said housing means and operatively connected to said pivotally-mounted, single diverter plate means, for optionally positioning said diverter plate means in one or another of two positions for directing the fluent material to one of said parallel supply chamber means, while simultaneously preventing flow of fluent material to the other of said parallel supply chamber means, and a pair of power-operated, control-valve-plate operating means, each of which being operatively connected to a respective one of said control valve plate means for optionally opening one of said supply chamber outlets while simultaneously closing and sealing another of said supply chamber outlets, such that one of said supply chamber means is being emptied while the other of said supply chamber means is being filled.

2. The apparatus as set forth in claim 1 in which said housing means includes at least two opposite walls, a support shaft extending between said opposite walls below said upper inlet, said diverter plate means including a rigid plate connected to and extending longitudinally of said support shaft and thereabove, and a pair of support plates depending in said housing and flanking said inlet, said support plates being disposed in the path of movement of said diverter plate for engagement along a free upper edge portion of said rigid plate whereby granular material descending through said inlet will wipingly engage one or the other of opposite surfaces of said diverter rigid plate upstream of one or the other of said supply chamber means.

3. The apparatus as set forth in claim 2 which said shaft has an integral plate depending radially below said shaft and movable therewith as said shaft is pivoted, a second pair of support plates extending between said opposite walls of said housing and parallel to said shaft and disposed in the path of pivotal movement of said integral plate for sealingly engaging the same as fluent material is fed into one or the other of said supply chambers.

4. The apparatus as claimed in claim 2 in which said shaft includes a pair of sector plates fixed to said shaft and extending radially above said shaft and defining sealing-end-plates on said shaft whereby granular material engaging said rigid diverter plate is restricted between said pair of sector plates.

5. The apparatus as set forth in claim 2 in which the opposite walls of said housing include recessed sealing areas opening toward each other; said recessed sealing areas including, a journal portion for said shaft, said recess portions each including divergent sealing areas extending radially from said journal portion, said sector plates each including a seal strip extending radially from said shaft and fixed to the outer surfaces of the sector plates whereby said seal strips will optionally engage the sealing areas depending upon which supply chamber is having fluent material being fed thereto.

6. The apparatus as claimed in claim 2 in which said support plates include resilient seal material fixed to the support plates for engaging the upper edge surface of the diverter plate opposite that engaged by fluent material being diverted.

7. The apparatus as claimed in claim 2 in which said inlet includes opposed, resilient wiper elements disposed in spaced relation in the path of travel of the upper edge of said diverter plate whereby material building up on said diverter plate is wiped off during alternated pivotal cycles of said diverter plate.

8. The apparatus as claimed in claim 1 in which said supply chamber means include a common partition extending beneath the pivotal mounting of said diverter plate means and defining a common side between said supply chamber means.

9. The apparatus as claimed in claim 8 in which a pair of walls diverge from a lower edge portion of said common partition and define a lower wall of the respective parallel supply chamber means;

said supply chamber means each including bottom, transverse plates extending toward and terminating short of said diverging walls and defining therewith an open bottom of the respective supply chamber means;

said valve plate means of the respective supply chamber means spanning beneath a diverging plate and transverse plate for controlling gravity descent of the fluent material.

10. The apparatus as claimed in claim 9 in which the lower edges of said common plate and said transverse plates including resilient seals engageable with upper surface portions of said valve plate means.

11. A method of feeding fluent material to a process device comprising the steps of:

a) providing a continuous supply of fluent material;

b) providing a single plate for diverting the continuous supply of fluent material to one or the other of a pair of parallel supply chambers and for sealing the supply chamber to which fluent material is not being directed;

c) permitting the other supply chamber which is filled with fluent material to gravity discharge the fluent material contained therein; and d) alternately maintaining the supply chambers sealed at their tops while being emptied, or at their bottoms while being filled whereby pressure and heat losses from the process device are minimized.

* * * * *